United States Patent [19]

Takasuga

[11] 4,060,106

[45] Nov. 29, 1977

[54] METHOD AND SYSTEM FOR PREVENTING CONTAINERLESS DISCHARGING OF FILLING MATERIAL IN CONTAINER FILLING APPARATUS

[75] Inventor: Kenji Takasuga, Yokohama, Japan

[73] Assignees: Kewpie Kabushiki Kaisha, Tokyo; Toyo Shokuhin Kikai Kabushiki Kaisha, both of Japan

[21] Appl. No.: 688,788

[22] Filed: May 21, 1976

[51] Int. Cl.[2] ..... B65B 3/04

[52] U.S. Cl. ..... 141/1; 141/140

[58] Field of Search ..... 141/140–143, 141/156–162

[56] References Cited

U.S. PATENT DOCUMENTS

| | | | |
|---|---|---|---|
| 2,761,605 | 9/1956 | Pahl et al. | 141/140 |
| 3,934,625 | 1/1976 | Tiernan et al. | 141/140 |

*Primary Examiner*—Houston S. Bell

*Attorney, Agent, or Firm*—Oblon, Fisher, Spivak, McClelland & Maier

[57] ABSTRACT

In a container filling apparatus having a plurality of revolving charging cylinders and respective pistons by which a fluid filling material supplied into the cylinders with their pistons at the limit end of their intake strokes is subsequently pushed out of the cylinders and through nozzles to fill respective containers at a filling position, the containers being preparatorily positioned on respective revolving platforms, the piston rod of each of the charging cylinders can be locked at the start of its intake stroke by a respective locking mechanism when the mechanism, as it revolves with the cylinder, contacts and is actuated by a stationary actuating device operated in accordance with a detection signal generated by a monitoring device. When this monitoring device detects the absence of an empty container from its preparatory position on any platform, it generates the detection signal to lock the corresponding piston rod thereby to prevent containerless discharging of the filling material. A stationary resetting cam operates to unlock this piston rod when it has revolved past the filling position.

7 Claims, 5 Drawing Figures

METHOD AND SYSTEM FOR PREVENTING CONTAINERLESS DISCHARGING OF FILLING MATERIAL IN CONTAINER FILLING APPARATUS

BACKGROUND OF THE INVENTION

This invention relates generally to apparatuses for charging or filling containers with fluid substances (hereinafter referred to as filling apparatuses). More particularly, the invention relates to a method and system for preventing containerless discharging wherein the filling apparatus carries out filling operation with respect to a filling station where a container does not exist.

In a filling apparatus, in general, when a filling operation is carried out by a filling nozzle without an empty container in preparatory state immediately below the filling nozzle, the fluid filling material flows out of the nozzle and onto the container platform and gives rise to troublesome dirtying of the apparatus.

Accordingly, in order to prevent this containerless discharging, it has been the general practice heretofore to resort to means by which the fluid material of the quantity for one filling once drawn into the pertinent charging cylinder is pushed back into a tank or hopper at the time of filling by means of the piston and is thus prevented from flowing toward the filling nozzle.

By the use of means of the character referred to above, however, when the filling material is a substance such as, for example, an emulsion of water and an oil, repetition of the action of pushing back of the material once introduced into a charging cylinder gives rise to a separation of the oil as a result of the flowing action, and this gives rise to the problem of lowering of the product quality.

SUMMARY OF THE INVENTION

In view of the above described problems, it is an object of this invention to provide a method and system for preventing the above mentioned containerless discharging, in which the above described problems in the prior art are solved by previously detecting the absence of a container in preparatory state in the filling station immediately below a filling nozzle and, in order to prevent containerless discharging, locking the piston of the pertinent charging cylinder so as to prevent drawing of the filling material into that charging cylinder thereby to eliminate flow movement of the filling material.

Another object of the invention is to provide a system of the above stated character for preventing containerless discharging which is of relatively simple organization and has a reliably positive operation.

According to this invention in one aspect thereof, briefly summarized, there is provided, in a container filling apparatus of rotary type having a plurality of charging cylinders arranged in a circle around a vertical main shaft to revolve thereabout and having respective pistons by which a fluid filling material is drawn from material supply means into the cylinders during intake strokes of the pistons and subsequently pushed during discharge strokes thereof out of the cylinders, through filling nozzles, and into respective containers preparatorily positioned on respective container platforms successively revolving into a filling position, a system for automatically preventing containerless discharging of the filling material in the absence of a container therefor, which system comprises: detecting means for detecting the absence of any container before its platform reaches the filling position and producing a detection signal; locking means each revolving with a respective charging cylinder and operating upon being actuated to lock the piston rod of that cylinder at a position where the piston is at the start of its intake stroke; actuating means operated in accordance with the detection signal to actuate the locking means corresponding to the platform without a container prior to the time that piston would normally start its intake stroke; and unlocking means for automatically unlocking a locked piston after that piston and the corresponding cylinder have revolve past the filling position thereby to prevent containerless discharging of the filling material.

The nature, utility, and furthers features of this invention will be more clearly apparent from the following detailed description with respect to preferred embodiments of the invention when read in conjunction with the accompanying drawings, in which like parts are designated by like reference numerals.

DETAILED DESCRIPTION OF THE PREFERRED EMBODIMENTS

Figure 1:
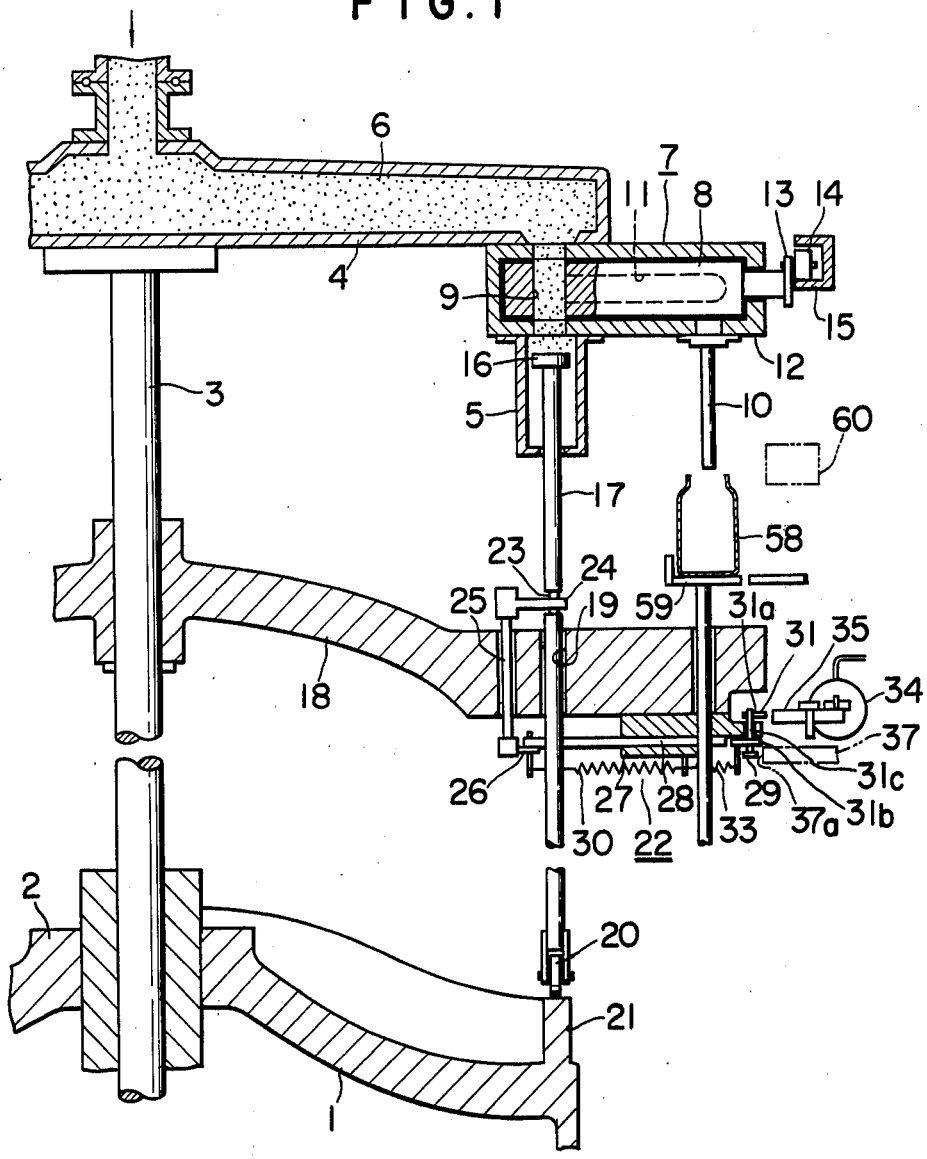
FIG. 1 is a fragmentary elevation, in vertical section, showing essential parts of one example of a filling apparatus in which this invention is applied.
Figure 3:
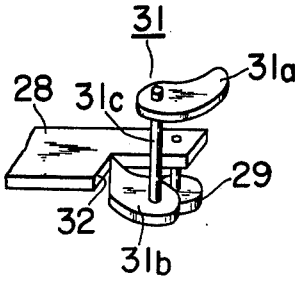
FIG. 3 is a relatively enlarged perspective view showing one part of the device illustrated in FIGS. 2(A) and 2(B)

Referring first to FIG. 1 illustrating one example of application of this invention to a rotary filling apparatus of pressure charging type, the apparatus or machine has a base structure 1 having a central, upright bearing pedestal 2 rotatably supporting a vertical means spindle or shaft 3, which is driven by means not shown and supports at its upper end a revolving support structure 4 fixed thereto. This support structure 4 supports therearound a plurality of charging cylinders 5 (only one being shown) arranged upright in a circle. These charging cylinders 5 are supplied with a filling fluid material to be charged from a material header chamber 6 formed within the support structure 4 and communicating at its upper central part with a pressure tank (not shown) for storing the filling material under pressure.

Between the header chamber 6 and each cylinder 5 there is provided a switching valve 7 comprising a cylindrical external casing 12, a rotatable cylinder valve 8, and a mechanism for actuating the valve 8. This valve 8 is provided therein with a passageway 9 communicating the header chamber 6 with the interior of the charging cylinder 5 and a passageway 11 for communicating the interior of the charging cylinder 5 with a filling nozzle 10. These communications are established alternately in accordance with the rotational position of the valve 8, which is rotated by the above mentioned actuating mechanism through a shaft fixed coaxially to the radially outer end of the valve 8 and extending outward through the valve outer casing 12.

The actuating mechanism comprises a crank arm 13 fixed at its proximal end to the above mentioned shaft, a roller 14 rotatably supported by the distal end of the arm 13, and an annular cam rail 15 engaged and followed by the roller 14. The cam rail 15 is fixed in space relative to the machine base 1. Accordingly, as the support structure 4 revolves around its vertical axis of revolution, predetermind undulations of the cam rail 15 are transmitted through this actuating mechanism to rotate the valve 8 thereby to effect switching between the valve passageways 9 and 11.

Each charging cylinder 5 is provided therein with a piston 16 having a downwardly extending piston rod 17, which is inserted downwardly through a hole in a revolving machine frame 18 fixed to and revolving with the main shaft 3. The piston rod 17 is provided at its lower end with a roller 20 rollably engaged with the following an annular cam 21 formed with predetermined undulations around one part of the base 1. Accordingly, as the main shaft 3 rotates, the roller 20 rolls over and follows this cam 21, whereby vertical movements are imparted to the piston rod 17 to actuate the piston 16 through its specified strokes. The downward stroke of the piston 16 draws the filling material from the header chamber 6, through the passageway 9 of the valve 8, and into the cylinder 5. The succeeding upward stroke of the piston 16 pushes the material thus drawn into the cylinder 5 out of the cylinder, through the passageway 11 of the valve 8 and the filling nozzle 10, and into a container 58 resting on a container platform 59.

In accordance with this invention, a locking device 22 for compulsorily stopping the descending movement of each piston rod 17 is provided on a member such as, for example, the revolving machine frame 18, which revolves around the main shaft 3 unitarily with the piston rod 17 as described below.

At one part of each piston rod 17 a stepped part 23 is formed by a method such as machining a cutout to function as an engagement part, and an engaging member 24 is provided to engage with and disengage from this stepped part thereby to stop and permit the vertical movement of the piston rod 17.

Figure 2A:
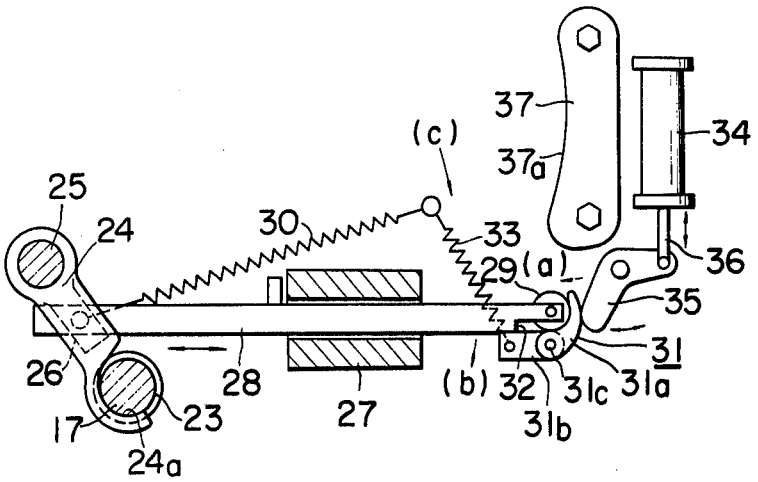
FIGS. 2(A) and 2(B) are plan views showing one example of a locking device in the system of this invention and respectively indicating operational states of a locking mechanism and its actuator and of a resetting cam.
Figure 2B:
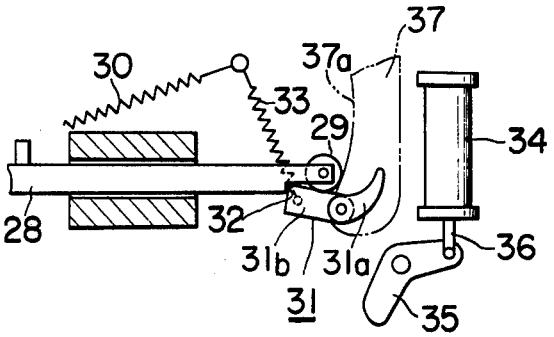

In the example of the system illustrated in FIGS. 1 and 2(A) and 2(B) a vertical shaft 25 is passed through and rotatably supported by the revolving frame 18 in the vicinity of each piston rod 17. A locking arm 24 is fixed at its proximal end to the upper end of the vertical shaft 25 and has at its distal end an engaging part 24*a* adapted to engage with and disengaging from the stepped part 23 of the piston rod 17 when the shaft 25 is turned counterclockwise and clockwise as viewed from above. The piston rod 17, the locking arm 24 and related parts are so designed that when this engaging part 24*a* is engaged with the stepped part 23, the piston is at its top dead center position or a position close thereto.

A crank arm 26 is fixed at its proximal end to the lower end of the vertical shaft 25 and is pivotally connected at its distal end to one end of a thrust bar 28, which is guided in movement in the arrow direction by a guide 27. This thrust bar 28 at its other end is provided with a roller 29 rotatably supported thereon and is continually urged by a tension spring 30, one end of which is anchored on a part of the revolving frame 18, to in the direction for causing the engaging part 24*a* of the above mentioned locking arm to engage with the stepped part 23 of the piston rod 17.

In the vicinity of the roller 29 of the thrust bar 28, a catch lever 31 is pivotally supported by a pin 31*c* on the revolving frame 18. This catch lever 31 comprises an integral combination of a release arm 31*a*, the pin 31*c* fixedly joined at one end thereof to the release arm 31*a*, and a catch arm 31*b* fixedly joined to the other end of the pin 31*c*. In assembled state, the release arm 31*a* is disposed to confront a lever 35 described hereinafter, and the outer end of the catch arm 31*b* is normally at a position where it is engaged with an engagement shoulder 32 formed on one side of the thrust bar 28 near its roller 29. A tension spring 33 anchored at one end to the revolving frame 18 is connected at its other end to the outer end of the catch arm 31*b* and imparts thereto a force which continually urges the catch arm 31*b* in the direction to engage the engagement shoulder 32, and which, when the catch arm 31*b* is so engaged, holds the locking arm 24 in the disengaged state with respect to the stepped part 23 of the piston rod 17.

The release arm 31*a* of the catch lever 31 is disposed at a level to confront the outer surface of an outer end of the above mentioned lever 35 of the bellcrank shape actuated by an air cylinder 34 installed on a fixed part of the filling apparatus in the position of the stage preceding that at which the filling material is to be introduced into each charging cylinder 5. When the piston rod 36 of the air cylinder 34 is extended as shown in FIG. 2(A), the release arm 31*a* of a catch lever 31 which has revolved to this position strikes against the outer surface of the end of the free arm of the lever 35 and is thereby turned in the arrow direction (*a*). Consequently, the catch arm 31*b* is turned in the arrow direction (*b*), and its outer end disengages from the engagement shoulder 32.

Furthermore, a cam 37 for adapted for resetting the locking device 22 and having a cam surface 37*a* is provided on a stationary part of the filling apparatus at a position such that, as the locking device 22 and related parts revolved about the main shaft 3 in the arrow direction (*c*) in FIG. 2(A), the roller 29 of the thrust bar 28 contacts the cam surface 37*a* before the above described release arm 31*a* strikes the end of the free arm of the lever 35. When the roller 29 thus contacts the cam surface 37*a*, the roller and the thrust bar 28 are pushed by the cam 37 toward the left as viewed in FIG. 2(A).

Figure 2C:
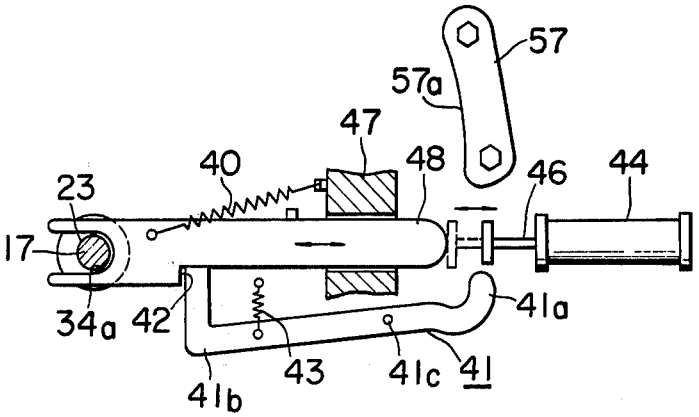
FIG. 2(C) is a plan view showing another example of the locking device and resetting cam in the system of this invention.

In another example of the locking device according to this invention as illustrated in FIG. 2(C) there is provided a thrust bar 48 slidably guided by a guide 47 in longitudinal advancing and retracting movements and having at its one (inner) and an engagement slot 34*a* for engaging with and disengaging from the stepped part 23 of the piston rod 17 of each of the charging cylinders 5. This thrust bar 48 is driven in its advancing movement to cause its slot 34*a* to engage with the stepped part 23 by the piston rod 46 of an air cylinder 44 disposed substantially coaxially with the thrust bar 48, the end of the piston rod 46 abutting against the other end of the thrust bar 48.

The thrust bar 48 is continually urged by a tension spring 40 to move in its retracting direction, that is, toward the piston rod 46 and out of engagement with the stepped part 23. This thrust bar 48 further has an engagement shoulder 42, which is engageable by the outer end of a catch arm 41*b* of a catch lever 41 pivotally supported on a pin 41*c* and having a release arm 41*a*. This catch lever 41 is continually urged by a tension spring 43 to rotate in the direction for engagement of the catch arm 41*b* with the engagement shoulder 42. The release arm 41*a* is positioned to come into sliding contact with the cam surface 57*a* of a cam 57 for resetting, whereupon the catch lever 41 is rotated counter to the biasing direction of the spring 43, that is; counterclockwise as viewed in FIG. 4, and the catch arm 41*b* disengages from the engagement shoulder 42.

Monitoring means 60 for detecting the absence of a container 58 on a container platform 59 is installed at a point in front of the filling position of that container platform 59 as viewed in the direction of revolution of the platform. This monitoring means 60 may be any suitable means (not shown) such as, for example, optical (photoelectric) detection means comprising a light projector, a light receiver, and an electrical circuit for generating an absence signal when the absence of an empty container 58 is detected. The absence signal is sent as an operational command signal to a control valve of a suitable pneumatic system (not shown) comprising an air pump, a reservoir, a relief valve, a pressure valve, and the control valve operating in response to the command signal to supply pressurized air to the air cylinder 34 (or 44). Since the monitoring means 60 and the pneumatic system may be of any known types, further description and specific illustration thereof is omitted.

The locking device of the above described structural organization according to this invention operates in the following manner.

At the time when the piston 16 of a charging cylinder 5 starts to descend in its downward or intake stroke in the operation of the filling apparatus described hereinbefore, pressurized air is not being supplied to the air cylinder 34 (or 44). Accordingly, in the example illustrated in FIG. 2, the outer end of the catch arm 31*b* of the catch lever 31 is engaged abuttingly with the engagement shoulder 32 of the thrust bar 28 as shown in FIG. 2(B), and the engaging part 24*a* of the locking arm 24 is held apart from the piston rod 17 and, therefore, cannot obstruct the ascent and descent of the piston rod 17.

In the case of the example illustrated in FIG. 2(C) the piston rod 46 of the air cylinder 44 is in its retracted position at the time of descent of the piston 16, and the thrust bar 48 is also in its retracted state, being urged against the piston rod 46 by the spring 40. Consequently, the engagement slot 34*a* of the thrust bar 48 is separated from the piston rod 17, and the forked end of the thrust bar 48 does not obstruct the vertical movement of the piston rod 17 similarly as in the first example.

When a charging cylinder 5 has arrived at the container filling positions, and an empty container 58 has been preparatorily placed in position on the corresponding container platform 59, the upper end of the cylinder 5 and the filling nozzle 10 are in communicative state through the passageway 11 of the valve 8, which has been rotated by the cam rail 15 through the roller 14 and arm 13. Then, as the piston rod 17 is forced upward by the cam 21, the piston 16 pushes the filling material which has previously been drawn into the charging cylinder 5 out of the cylinder 5, through the passageway 11 and the filling nozzle 10, and into the container 58.

In the above described manner, the containers 58 are successively supplied and placed in prescribed positions on respective container platforms 59, and the filling process is carried out by the charging cylinders 5. However, if, for some reason, a container 58 is not positioned on a container platform 59, which is thereby not in a preparatory state for filling, this state is detected in advance by the container absence monitoring means 60, which operates to cause pressurized air to be supplied to the air cylinder 34 (or 44) when the charging cylinder 5 whose container 58 has not been prepared revolves to the position indicated in FIG. 2(A) or 2(C) whereupon the piston rod 36 (or 46) is thrust outward.

Consequently, in the device illustrated in FIGS. 2(A), 2(B), the lever 35 rotates in the clockwise direction as viewed in the figure and pushed against the release arm 31*a* of the catch lever 31. The catch arm 31*b* is thereby disengaged from the engagement shoulder 32 of the thrust bar 28, as indicated in FIG. 2(A), whereupon the thrust bar 28 is moved rightward as viewed in FIG. 2(A) by the force of the spring 30. This movement is transmitted through the arm 26 to rotate the shaft 25 and the locking arm 24, whereby the engaging part 24*a* of the locking arm 24 is pressed against the piston rod 17 of the above mentioned charging cylinder 5.

When the stepped part 23 of this piston rod 17, which is descending at this time as a result of the action of the cam 21, reaches the level of the locking arm 24, it is engaged and locked by the engaging part 24*a* of the locking arm, whereby the piston rod 17 is locked and prevented from descending further, and the piston 16 cannot descend from the vicinity of the upper dead-center point. Consequently, the filling material is prevented from being charged into the charging cylinder 5.

In the case of the example illustrated in FIG. 2(C) pressurized air sent to the air cylinder 44 when the absence of a container 58 is detected, similarly as in the example shown in FIGS. 2(A) and 2(B) and the piston rod 46 of the air cylinder 44 is thrust outward. Consequently, the thrust bar 48 is pushed toward the piston rod 17 against the force of the spring 40, and the outer tip of the catch arm 41*b* of the catch lever 41 urged to rotate clockwise by the spring 43 engages with the engagement shoulder 42 of the thrust bar 48 as indicated in FIG. 2(C). At the same time, the engagement slot 34*a* of the thrust bar 48 engages with the stepped part 23 of the piston rod 17, thereby locking the piston 16 against further descent, as indicated in FIG. 2(C).

When the piston rod 17 of the above mentioned charging cylinder 5 has been compulsorily locked against movement in this manner, the pressurized air in the air cylinder 34 (or 44) is released, and the piston rod 36 (or 46) returns to its original normal position. On the side of the charging cylinder 5, on the other hand, when this charging cylinder has revolved past its filling position in the case of the example illustrated in FIG. 2, the roller 29 of its thrust bar 28 is pushed by the cam surface 37*a* of the resetting cam 37, and the thrust bar 28 slides leftward as viewed in FIG. 2. As a consequence, the catch arm 31*b* of the catch lever 31, which is being pulled by the spring 33 in the clockwise direction, engages with the engagement shoulder 32 of the thrust bar 28 as indicated in FIG. 2(B), whereby the thrust bar 28 is prevented from returning. At the same time, the engaging part 24*a* of the locking arm 24 disengages from the stepped part 23 of the piston rod 17 to release the piston rod 17 from its locked state.

In the case of the example illustrated in FIG. 2(C) the release arm 41*a* of the catch lever 41 is pushed by the cam surface 57*a* of the resetting cam 57, whereupon the outer tip of the catch arm 41*b* of the same catch lever 41 disengages from the engagement shoulder 42 of the thrust bar 48. The thrust bar 48 is therefore pulled back by the force of the spring 40, and its engagement slot 34*a* disengages from the stepped part 23 of the piston rod 17, which is thereby released from its locked state.

Thus, in accordance with this invention, the absence of an empty container on any container platform in filling position below a filling nozzle is detected in advance by monitoring means, which thereupon operates to cause the piston rod of the corresponding charging cylinder to be locked at or near the upper dead-center position of the piston thereby to prevent drawing of the filling material into that charging cylinder and thereby to prevent containerless discharging. Accordingly, there is no flow of the filling material between the charging cylinder and the supply tank or hopper each time containerless discharging is prevented as in known filling apparatuses. Therefore, even with a filling material such as an emulsion, there is no possibility of lowering its product quality.

Furthermore, since filling material which has once been introduced into a charging cylinder is never forced back into the tank side, there is no possibility of the piston being subjected to excessive load and of the piston and its actuating mechanism being subjected to damage and early wear, whereby various advantages such as remarkably prolonged serviceable life are afforded.

It should be understood that the foregoing disclosure relates to only preferred embodiments of the invention and that they are intended to cover all changes and modifications of the examples of the invention herein chosen for the purposes of the disclosure, which do not constitute departures from the spirit and scope of the invention. For example, instead of the air cylinders 34 and 44 used in the above described examples of the invention, solenoids or hydraulic cylinders operated by a command signal from the monitoring means can be used with equal effectiveness to bring about locking of the pertinent piston rod 17.

I claim:

1. In a method of filling successively a prescribed quantity of a fluid material into respective containers by means of a plurality of charging cylinders arranged in a circle around a vertical main shaft to revolve therearound and having respective pistons while precluding discharge of the fluid material in the absence of a container to be filled, each of the cylinders being adapted to introduce thereinto the fluid material from a header chamber during the intake stroke of the piston thereof and then to discharge its filled material into a corresponding container during the discharge stroke of the piston, passageways of the introduction and discharge of the fluid material being established through a switching valve member, and switching of the valve member and reciprocal stroke of the cylinder piston being caused in relation to the revolution of the charging cylinders, an improvement in the preclusion process for discharge of the fluid material in the absence of a container to be filled comprising when the absence of a container at a filling position on a container platform is detected, the piston of the charging cylinder corresponding to the filling position is locked in response to the detection against the intake stroke thereof prior to the intake stroke and the locking is released after the piston and its cylinder have revolved past the filling position in order to prevent containerless discharging of the fluid material.

2. In a container filling apparatus of rotary type comprising a plurality of fluid material charging cylinders arranged in a circle around a vertical main shaft to revolve thereabout and having respective pistons, a plurality of containers preparatorily provided on respective container platforms which are successively revolved into a filling position in relation to revolution of the charging cylinders, each of the charging cylinders being adapted to introduce a fluid material thereinto from a material header chamber during the intake stroke of the piston thereof and subsequently to discharge its filled material into the corresponding container at its filling position on the container platform during the discharge stroke of the piston, a switching valve member for establishing passageways for the introduction and discharge of the fluid material, switching of the valve member and a reciprocal stroke of the cylinder piston being effected with respect to revolution of the charging cylinders, and a precluding means adapted to preclude containerless charging of the fluid material when the absence of a container at a filling position is detected, and improvement of the precluding means, the precluding means comprising: detecting means adpated to detect the absence of a container at the filling position and to produce a command signal when absence is detected; locking means including a locking device provided revolvably together with a respective charging cylinder, the locking device being adapted to be actuated to lock the piston rod of the respective charging cylinder at a position where the piston rod is at the start of its intake stroke; and actuating means adapted to be operated by the command signal of the detecting means to actuate the locking device corresponding to a specific filling position on the container platform having no container mounted thereon causing locking of the piston rod of the charging cylinder corresponding to the filling position against the intake stroke thereof prior to the intake stroke; and unlocking means adapted for unlocking the locking device after the piston rod and the corresponding charging cylinder have revolved past the filling position in order to preclude containerless discharge of the filling material.

3. A container filling apparatus as claimed in claim 2 wherein the locking device comprises an engaging member having an engaging part engageable with and disengageable from a stepped part formed in the piston rod in order to lock and unlock the piston rod, a thrust bar coupled at one end thereof to the engaging member and adapted to undergo locking and unlocking strokes respectively to move the engaging part into and out of engagement with the stepped part, a spring for continuously urging the thrust bar in the direction for locking the piston rod, and a catch lever engageable with an engagement shoulder of the thrust bar to lock the bar at the end of the unlocking stroke by the force of a spring in a normal state; the actuating means comprising an actuating device operated by a command signal from the detecting means to disengage the catch lever from the engagement shoulder of the thrust bar corresponding to the platform having no container mounted thereon in order to permit the thrust bar to move during the locking stroke under the force of the spring; and the unlocking means comprising a cam member stationarily disposed in a position to be contacted at its cam surface by the other end of the thrust bar undergoing revolution in order to force the thrust bar during the unlocking stroke against the force of the spring until the catch lever engages with the engagement shoulder thereof.

4. A container filling apparatus as claimed in claim 2, wherein the locking means comprises a thrust bar provided for each piston rod of each charging cylinder and having at one end thereof an engagement slot engageable with and disengageable from a stepped part formed in the piston rod in order to lock or unlock the piston rod, the one end of the thrust bar constituting the locking part and the thrust bar being adapted to undergo locking and unlocking strokes respectively to place the engagement slot into and out of engagement with the stepped part, a spring to continuously urge the thrust bar in the direction of the unlocking stroke in order to normally position the thrust bar at the end of the unlocking stroke, a catch lever having a release arm and a catch arm engageable with an engagement shoulder of the thrust bar to lock the thrust bar at the end of the locking stroke, and a spring for urging the catch lever to the position engageable with the engagement shoulder; the actuating means comprising an actuating device operated by the command signal from the detecting means and adapted to push the thrust bar when the device is operated toward the piston rod against the force of the spring in order to cause engagement of the engagement slot with the stepped part of the piston rod and to cause movement of the catch arm to the position adaptable to be engaged with the engagement shoulder of the thrust bar; and the unlocking means comprising a resetting cam stationarily disposed in a position to be contacted at its cam surface by the revolving catch lever of the thrust bar in order to push the release arm and to cause disengagement of the catch arm from the engagement shoulder against the force of the spring to cause the unlocking stroke of the thrust bar by the spring.

5. A system as claimed in claim 2 in which the actuating means is an air cylinder-and-piston actuator operated by air supplied from a pneumatic power supply operated in accordance with said detection signal.

6. A system as claimed in claim 2 in which the actuating means is an electromagnetic actuator operated by electrical power from an electric power supply operated in accordance with said detection signal.

7. A system as claimed in claim 2 in which the actuating means is a hydraulic cylinder-and-piston actuator operated by hydraulic fluid supplied from a hydraulic power supply operated in accordance with said detection signal.

* * * * *